United States Patent [19]

Paster et al.

[11] Patent Number: 4,530,501

[45] Date of Patent: Jul. 23, 1985

[54] CONVERSION APPARATUS FOR BOWLING PIN SETTING MACHINE

[75] Inventors: Ernest E. Paster, Green Lane, Pa.; David Paster, Williamstown, N.J.

[73] Assignee: Eastern Bowling Equipment Company, Philadelphia, Pa.

[21] Appl. No.: 510,018

[22] Filed: Jul. 1, 1983

[51] Int. Cl.[3] ..... A63D 5/00

[52] U.S. Cl. ..... 273/43 R; 273/49; 273/53; 273/54 A

[58] Field of Search ..... 273/43 R, 43 A, 49, 273/54 R, 54 A, 53

[56] References Cited

U.S. PATENT DOCUMENTS

| | | | |
|---|---|---|---|
| 3,233,901 | 2/1966 | Sandahl | 273/49 X |
| 3,248,110 | 4/1966 | Webb | 273/49 |
| 3,319,959 | 5/1967 | Lenhart | 273/43 R |
| 3,545,753 | 12/1970 | Lenhart | 273/43 R |
| 3,545,754 | 12/1970 | Lenhart | 273/43 R |
| 3,790,167 | 2/1974 | Lenhart et al. | 273/43 R |
| 4,036,495 | 7/1977 | Blawn et al. | 273/43 R |

*Primary Examiner*—Anton O. Oechsle

*Attorney, Agent, or Firm*—Seidel, Gonda, Goldhammer

[57] ABSTRACT

A kit is provided for converting a known type of automatic bowling pin setting machine to decrease the cycle time thereof. The kit includes electronic circuitry having an electrical switch adapted to be responsive to contact between a bowling ball and a pit cushion. Actuation of said switch initiates release of a latch so that at least a portion of a rake may descend immediately upon contact of the ball with the cushion.

3 Claims, 6 Drawing Figures

20
32
34
84
36
38
30
28
46
50
40
82
26
24
80
22
10
40
44
42
12
14
15
16
2
18
86
88
92
2

CONVERSION APPARATUS FOR BOWLING PIN SETTING MACHINE

BACKGROUND OF THE INVENTION

Apparatus of the general type to be converted by the present invention is disclosed in U.S. Pat. No. 2,729,449. In the apparatus as disclosed in said patent in actual practice there is approximately an 18 second delay in returning the ball to the bowler. There is a need for a conversion device which will expedite returning the ball to the bowler to thereby speed up the playing of the game. The present invention will reduce the ball return time as much as 6 seconds and will enable a game in a typical league to be completed as much as forty-five minutes earlier. Some portions of the apparatus disclosed in U.S. Pat. No. 3,233,901 are disclosed herein.

The present invention is directed to a solution of the problem of how to provide a conversion kit for speeding up bowling while making minimal changes in the known existing equipment.

SUMMARY OF THE INVENTION

The present invention is directed to a kit for converting a known type of automatic bowling pin setting apparatus for decreasing the cycle time thereof. The kit includes electronic circuitry having an electrical switch adapted to be responsive to contact between a bowling ball and a pit cushion. Circuitry includes a solenoid for initiating release of a latch so that at least a part of a rake may descend immediately upon contact of the ball with the cushion. The circuitry includes an adjustable timer associated with a relay forming a part of the machine control.

For the purpose of illustrating the invention, there is shown in the drawings a form which is presently preferred; it being understood, however, that this invention is not limited to the precise arrangements and instrumentalities shown.

DETAILED DESCRIPTION

Figure 1:
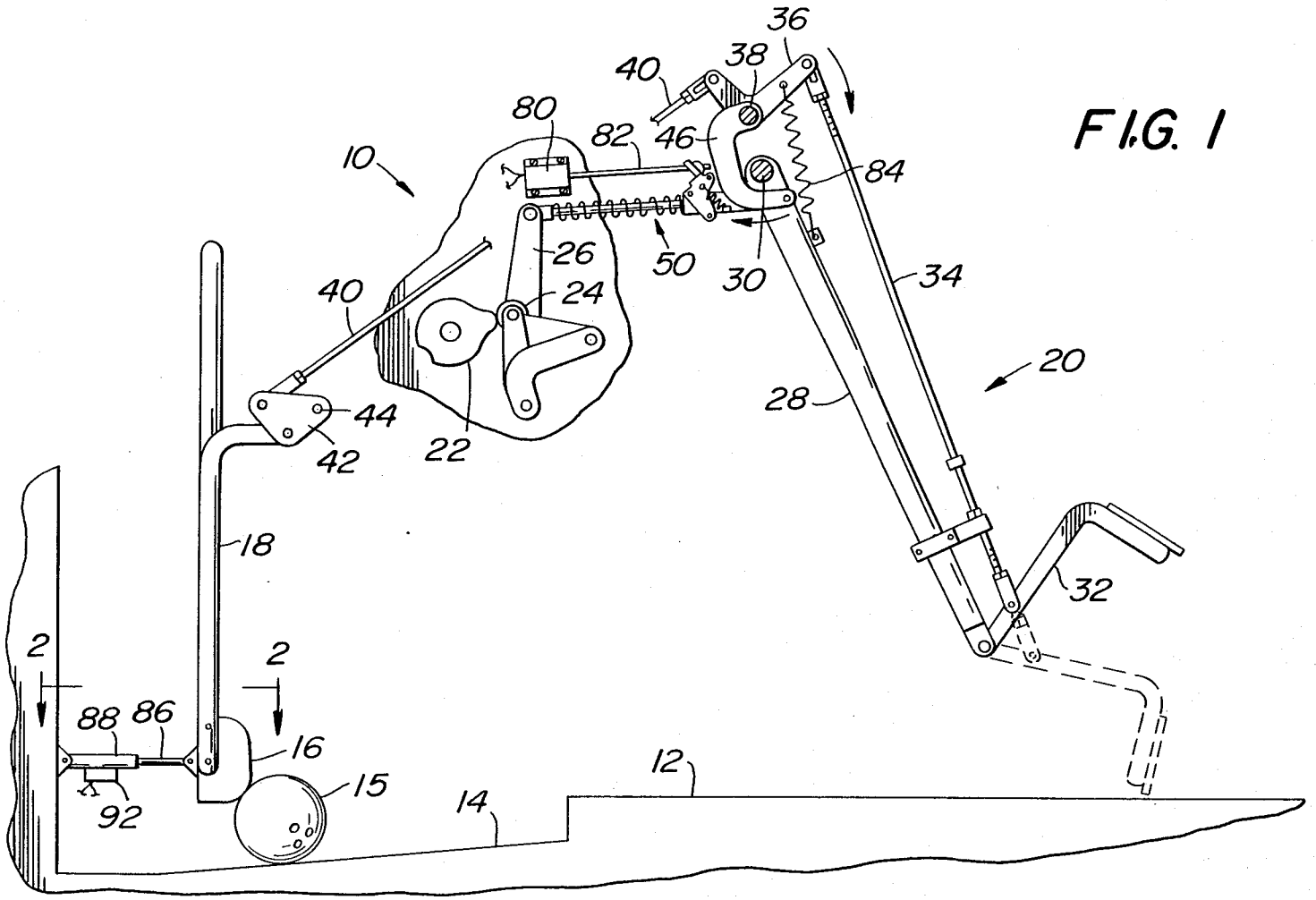
FIG. 1 is a side elevation view of a portion of the pin setting apparatus at the pit.

Referring to the drawing in detail, wherein like numerals indicate like elements, there is shown in FIG. 1 a portion of an automatic pin setting machine designated generally as 10 and associated with the downstream end of the alley 12 which terminates in a inclined pit 14. Within the pit 14 there is provided a cushion 16. Cushion 16 is supported at its ends by a lift rod 18 and is adapted for upward movement to release the bowling ball 15.

The machine 10 includes a cam 22 in contact with a cam follower 24. Cam follower 24 is associated with a linkage for pivoting a lever 26. Lever 26 is coupled to a rake designated generally as 20. The rake 20 includes an inclined arm 28 having a movable extension portion 32 which is generally L-shaped at its lower end. Extension 32 is moved between the solid line position and the phantom position by a rod 34. Rod 34 is pivotably coupled to extension 32 at its lower end and pivotably coupled to one arm of a bell crank 36 at its upper end. Bell crank 36 pivots about shaft 38.

The other arm of the bell crank 36 is pivotably connected to one end of an arm 40. The other end of arm 40 is pivotably coupled to a lever 42. Lever 42 is pivotably connected to a stationary pin 44 and is pivotably connected to the lift rod 18 for the cushion 16.

Figure 4:
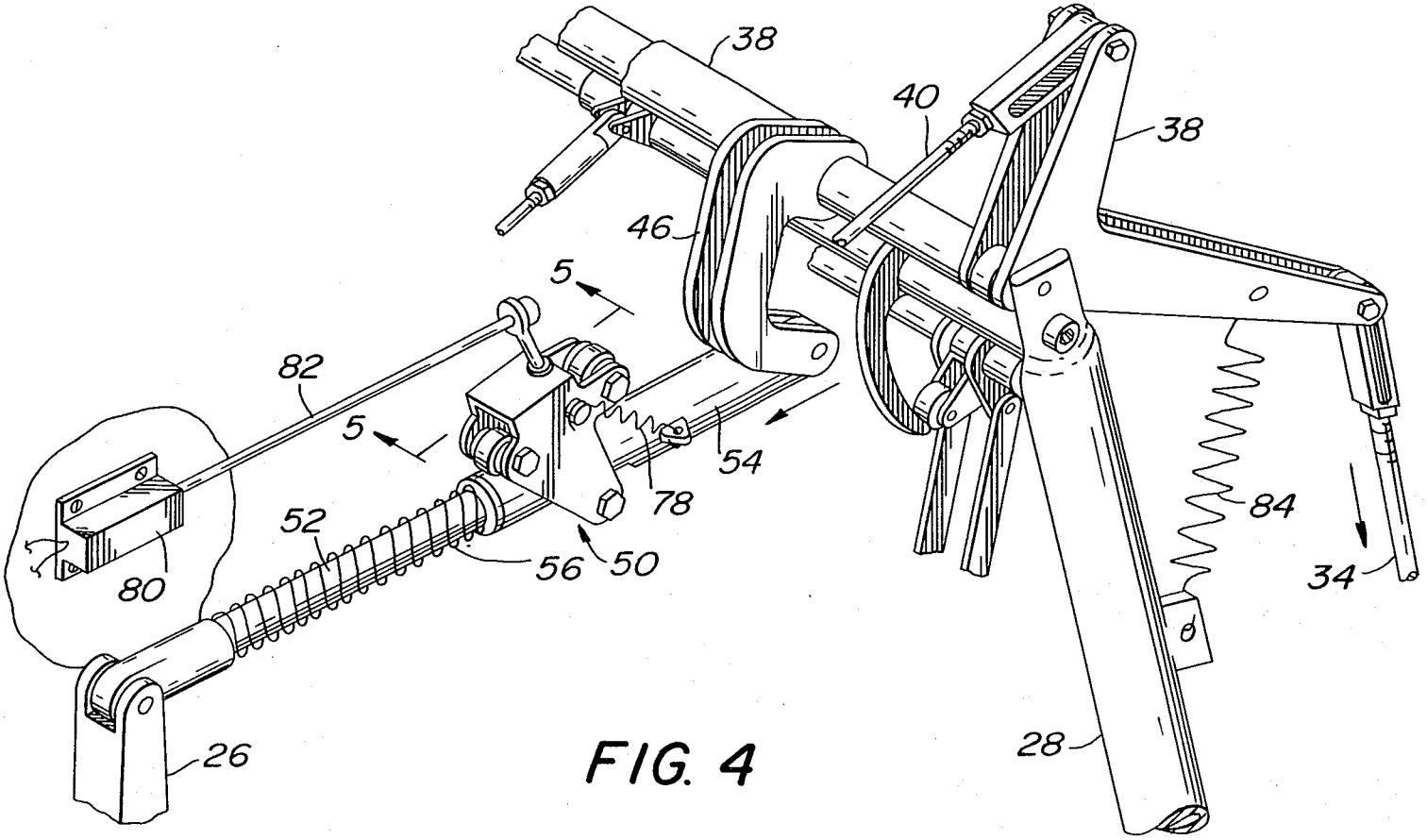
FIG. 4 is a prospective view of the upper end of the rake and latching mechanism associated therewith.

The upper end of arm 28 is fixed to a rake lift shaft 30. The upper end of arm 28 is also pivotably coupled to a C-shaped arm 46. Arm 46 is pivotably coupled to shaft 38, as is most clearly shown in FIG. 4. Additional structure of the apparatus disclosed in Pat. No. 2,729,449 is shown in FIG. 4 to place the present invention in context, although such additional structure is not part of the present invention.

Figure 5:
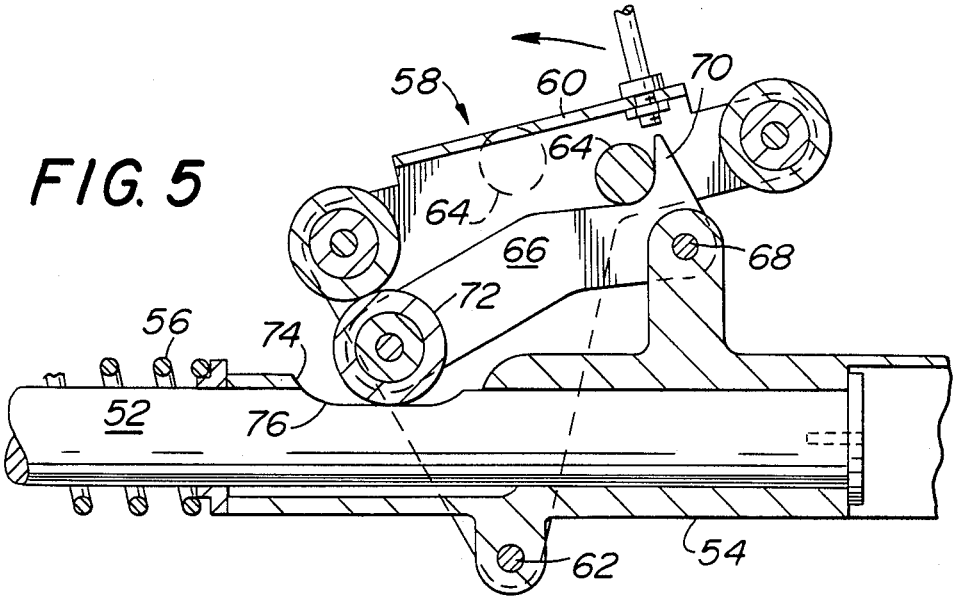
FIG. 5 is a sectional view taken along the line 5—5 in FIG. 4.

Lever 26 is coupled to the arm 46 by way of a rake trip latch assembly designated generally as 50. The rake trip latch assembly 50 includes telescoping shafts 52 and 54. A spring 56 surrounds the shaft 52 and abuts one end of the shaft 54. See FIGS. 4 and 5. A latch designated generally as 58 is mounted on the shaft 54. Latch 58 includes a body 60 having legs pivoted to opposite sides of the shaft 54 by pin 62. The legs of body 60 support a latch retainer 64. Latch retainer 64 maintains latch 66 in a downward position as shown in FIG. 5. Latch 66 is pivoted about pin 68 which is supported by the shaft 54.

At the end of latch 66 remote from pin 68, there is provided a roller 72. Roller 72 extends through a slot 74 in shaft 54 and into a groove 76 on the shaft 52. Retainer 64 cooperates with the projection 70 to prevent the roller 72 from unintentionally moving upwardly.

A spring 78 extends between shaft 54 and body 60 for maintaining the latch in a position as shown in FIG. 5. A solenoid 80 has its plunger connected to rod 82. Rod 82 is pivotably connected to a projection on the latch body 60. When the solenoid 80 is activated, latch body 68 pivots counterclockwise in FIG. 5 to thereby move the retainer 64 to the phantom position. When retainer 64 is in the phantom position, latch 66 may pivot upwardly and permit collapse of the telescoping shafts 52, 54. When the shafts 52, 54 telescope, arm 28 pivots clockwise in FIG. 1 thereby causing spring 84 to pivot the bell crank 36 in a clockwise direction in FIG. 1. Such movement of bell crank 36 causes the extension 32 to move from the solid line position to the phantom position in FIG. 1, i.e., it drops the rake, and at the same time causes rod 40 to elevate the cushion 16 by means of lift rod 18.

Figure 2:
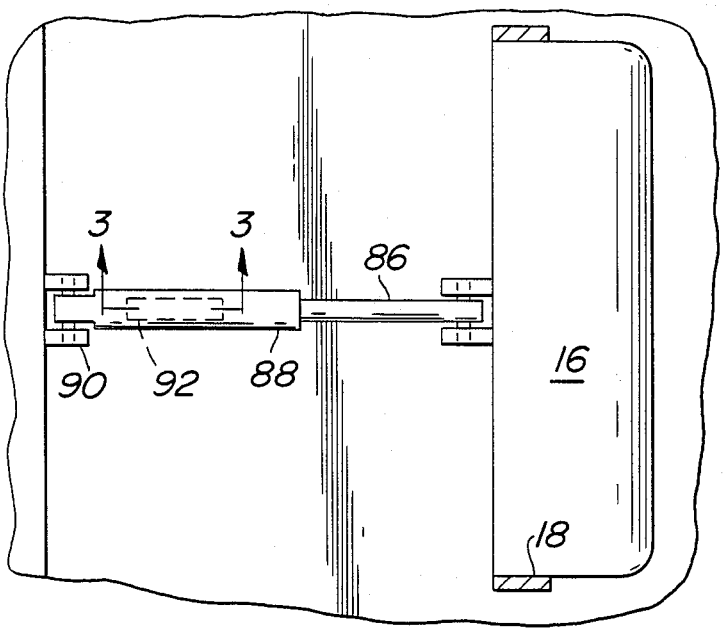
FIG. 2 is a view taken along the line 2—2 in FIG. 1 but on an enlarged scale.
Figure 3:
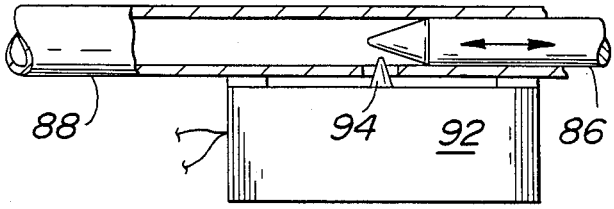
FIG. 3 is a sectional view taken along the line 3—3 in FIG. 2.

Referring to FIGS. 2 and 3, a rod 86 has one end hinged to the rear surface on the cushion 16. The other end of rod 86 is conical and telescopes into a sleeve 88. Sleeve 88 is attached by way of hinge 90 to the rear wall of the pit 14. The conical end of rod 86 is adapted to cooperate with an actuator 94 on a microswitch 92 which is attached to the sleeve 88.

Figure 6:
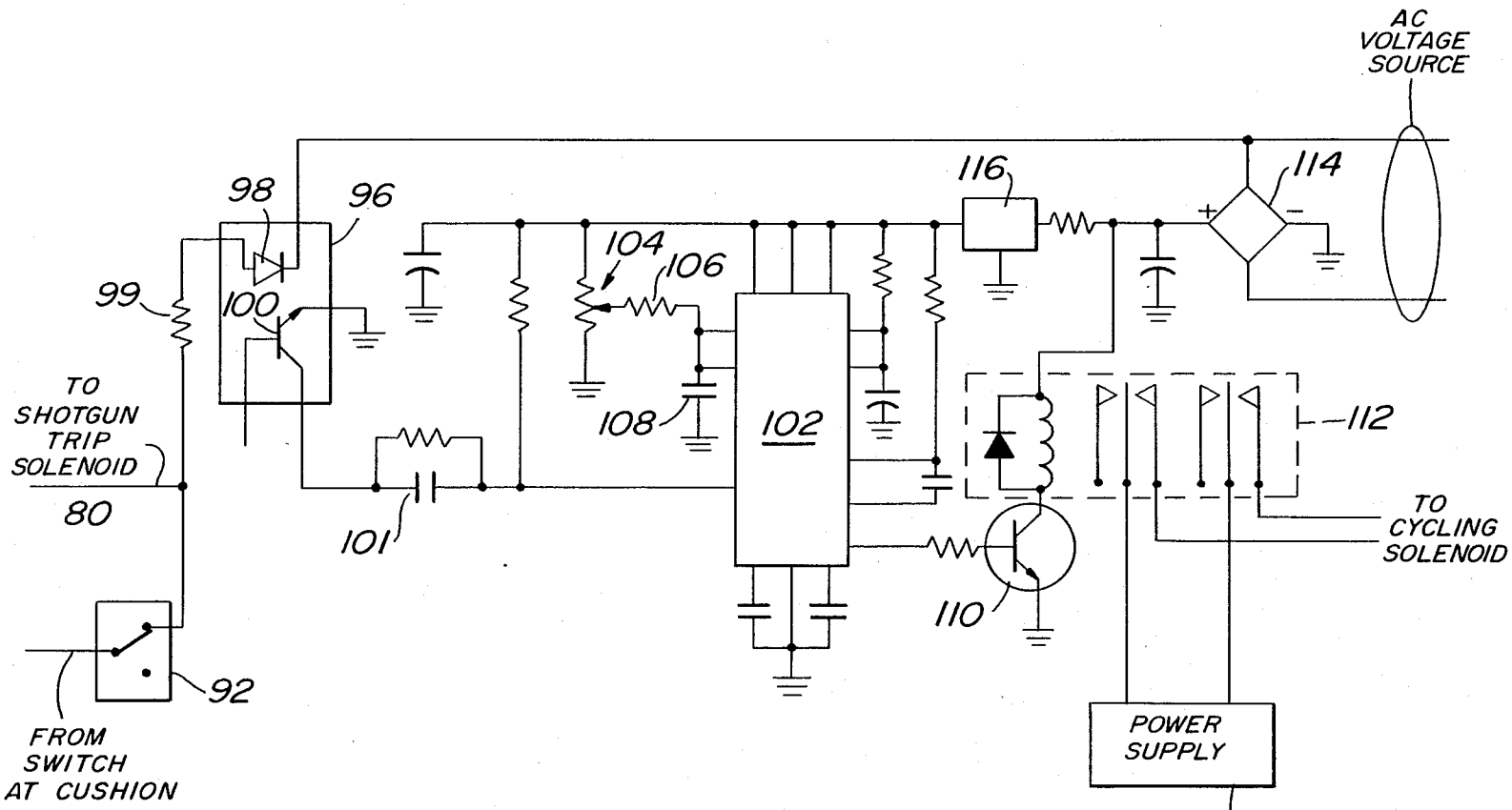
FIG. 6 is a schematic diagram of electrical circuitry.

Referring to FIG. 6, it will be noted that as soon as switch 92 is closed, an electrical potential is coupled to the solenoid 80 which releases the latch 58. At the same time, the potential is coupled to an optical switch 96. Optical switch 96 includes a light emitting diode (L.E.D.) 98 in series with current limiting resistor 99, which triggers a transistor 100 when L.E.D. 98 is energized. Transistor 100 is coupled via filter network 101 to a solid state electrical timer 102.

Timer 102 may be any known integrated circuit timer, and the period of the timer may be varied by way of potentiometer 104 and by choosing the appropriate values for the resistor 106 and capacitor 108. The unnumbered resistors and capacitors associated with timer 102 provide appropriate inputs to the timer circuitry and are selected in known manner as required by the particular timer used. The output from timer 102 is coupled to the transistor 110 which controls the relay 112. Relay 112 energizes the cycling solenoid, which is associated with the control of the machine 10 by connecting the cycling solenoid to a power supply so that, apart from the rake, machine 10 may be cycled in a conventional manner.

The light emitting diode 98 is coupled to one leg of a rectifier bridge 114, which converts the alternating current to direct current for operating the circuitry. The positive side of the rectifier 114 is coupled to the circuitry through a voltage regulator 116, which serves to smooth out the rectified voltage in known manner.

The kit of the present invention includes the circuitry shown in FIG. 6 (but excluding relay 112), rake trip latch assembly 50, the solenoid 80 for actuating the latch 58, switch 92, and a mechanism for actuating switch 92. Immediately upon contact between the bowling ball and the cushion 16, the cushion 16 is immediately elevated to permit return of the ball 15. As a result thereof, the cycle time of the machine is speeded up whereby league play may be concluded by as much as 45 minutes earlier than normal with the conventional machine.

The present invention may be embodied in other specific forms without departing from the spirit or essential attributes thereof and, accordingly, reference should be made to the appended claims, rather than to the foregoing specification as indicating the scope of the invention.

We claim:

1. A kit for converting a known type of automatic bowling pin setting apparatus for decreasing the cycle time thereof comprising electronic circuitry which includes an electrical switch adapted to be responsive to contact between a bowling ball and a pit cushion, said circuitry including a solenoid for initiating release of a latch so that at least a portion of a rake may descend immediately upon contact of the ball with the cushion and permit recycling of the ball, an adjustable timer for association with a relay forming a part of the machine control, and telescoping members one of which is adapted to be pivotably coupled to said pit cushion, one of said members supporting said electrical switch which is actuable by the telescoping movement of said members.

2. A kit for converting a known type of automatic bowling pin setting apparatus for decreasing the cycle time thereof comprising electronic circuitry which includes an electrical switch adapted to be responsive to contact between a bowling ball and a pit cushion, said circuitry including a solenoid for initiating release of a latch so that at least a portion of a rake may descend immediately upon contact of the ball with the cushion and permit recycling of the ball, an adjustable timer for association with a relay forming a part of the machine control, and a noise isolator between said electrical switch and said timer.

3. In an automatic bowling pin setting machine of the type having a pit cushion at the rear thereof arranged to be impacted by a bowling ball after the ball has passed the area of the lane whereon bowling pins are set and a rake for clearing the lane of pins knocked down by the ball, wherein the machine cycle including lifting the pit cushion and actuating the rake is initiated mechanically by movement of a rigid linkage in response to ball impact on the pit cushion, apparatus for decreasing the cycle time thereof, comprising:

(a) an electric switch actuated by ball impact on the pit cushion;

(b) an electronic circuit responsive to the electric switch and including an adjustable time delay for initiating the machine cycle a selectable time after the ball has impacted the pit cushion; and (c) in lieu of said rigid linkage an electromechanical rake lift latch assembly immediately responsive to actuation of the electric switch for actuating the rake and elevating the pit cushion before the initiation of the machine cycle by the electronic circuit.

* * * * *